US006071180A

United States Patent [19]

Becker

[11] Patent Number: 6,071,180

[45] Date of Patent: Jun. 6, 2000

[54] METHOD OF SURFACE GRINDING A FLANGE SURFACE OF A WHEEL HUB FOR AN AUTOMOTIVE VEHICLE

[75] Inventor: Manfred G. Becker, Novi, Mich.

[73] Assignee: Ernst Thielenhaus GmbH & Co. KG, Wuppertal, Germany

[21] Appl. No.: 09/233,595

[22] Filed: Jan. 19, 1999

[51] Int. Cl.[7] ..... B24B 1/00

[52] U.S. Cl. ..... 451/63; 451/281; 451/283; 451/398; 29/894.362

[58] Field of Search ..... 451/63, 51, 6, 451/268, 259, 913, 49; 29/894.36, 894.362, 898.07

[56] References Cited

U.S. PATENT DOCUMENTS 4,361,988 12/1982 Gramlich ..... 451/63
4,766,702 8/1988 Kinner ..... 451/63
4,959,902 10/1990 Hamilton ..... 29/898.07
5,430,926 7/1995 Hartford ..... 451/63
5,807,162 9/1998 Dana ..... 451/413

*Primary Examiner*—David A. Scherbel
*Assistant Examiner*—George Nguyen
*Attorney, Agent, or Firm*—Herbert Dubno

[57] ABSTRACT

A process for surface grinding of a flange surface of a wheel hub onto which a brake disk can be mounted for a motor vehicle includes the mounting of the wheel bearing on the wheel hub before the grinding operation. An outer bearing ring is then clamped on a stationary support and, as the wheel hub is rotated, the surfaces ground by a cup-shaped grinding disk rotated about an axis parallel to that of the axis of rotation of the hub.

4 Claims, 2 Drawing Sheets

METHOD OF SURFACE GRINDING A FLANGE SURFACE OF A WHEEL HUB FOR AN AUTOMOTIVE VEHICLE

FIELD OF THE INVENTION

My present invention relates to a method of surface grinding a flange surface of a wheel hub for a motor vehicle and, more particularly, for the grinding of such surface so that it is planar and perpendicular to the axis of the wheel hub within very narrow tolerances.

BACKGROUND OF THE INVENTION

The machining of flange surfaces of a wheel hub and especially the surface grinding thereof is important since those surfaces are attachment surfaces for the brake disks of wheel hubs which are provided with disk brakes.

When the flange surface is not planar to within a narrow tolerance and not exactly perpendicular to the axis of rotation of the wheel hub, the brake disk attached to the flange and rotating with the wheel hub has a certain degree of wobble and shows angular position-dependent offset movements in the axial direction that can be described as knocking or flapping. Indeed, even very slight angle-dependent offset movements or wobble can translate into vibration which is transmitted to the brake pedal and can be noticeable during the braking operation. Machining defects at the flange surface of the wheel hub become all the more noticeable and significant as the brake disk attached thereto is of larger diameter. The problem is, therefore, usually more noticeable on small transport-type vehicles or utility vehicles like pick-up trucks, heavier trucks and similar utility vehicles than it is for passenger-type vehicles like automobiles.

In conventional fabrication methods the surfaces of the wheel hub are finish-machined before the wheel bearings are mounted on the hub. Following mounting of the hub and the wheel bearing in a vehicle, as a unit, a problem with wobble can be discovered upon rotation of the wheel hub. Depending upon the particular vehicle, it is not uncommon to have a rotation-angle-dependent offset movement in the axial direction which is of the order of 40 to 60 $\mu$m. That magnitude of offset or axial throw will give rise to detrimental wobble. With increasing diameter of the brake disk, the wobble is more severe. The axially offset movement, likewise which is rotation-angle dependent of the brake disk can amount to up to 100 $\mu$m and magnitudes of this nature give rise to significant vibration at the brake pedal when the brake is actuated.

OBJECTS OF THE INVENTION

It is the principal object of the present invention, therefore, to provide a method of surface grinding the flange surface of a wheel hub for an automotive vehicle, especially the flange surface to which a larger diameter brake disk is to be affixed, so that the measurable axial offset or throw is less than 10 $\mu$m and preferably less than 5 $\mu$m and the wobble is negligibly small.

Another object of the invention is to provide a method of making a wheel hub having a flange to which a brake disk can be attached whereby drawbacks of earlier fabrication methods are avoided.

Still another object of the invention is to provide an improved method of machining the flange surface of a wheel hub flange so that it is perpendicular to the hub rotation axis with acceptably small tolerance.

SUMMARY OF THE INVENTION

These objects and others which will become apparent hereinafter are attained, in accordance with the invention by a method of surface grinding a planar flange surface of the flange of a wheel hub, the method comprising the steps of:

(a) fitting a wheel hub having a flange with a surface to be ground with a wheel bearing having an outer bearing race formed with a mounting surface for attachment to a motor vehicle;

(b) clamping the mounting surface of the outer bearing race to a stationary workpiece carrier, thereby mounting the wheel hub on the workpiece carrier; and (c) rotating the wheel hub and the flange about a hub axis and contacting the surface of the flange with a rotating grinding disk, thereby surface grinding the flange.

The surface grinding is a plane grinding of the flange surface, i.e. so grinds the surface that it lies in a plane perpendicular to the axis of rotation of the wheel hub and with an axial tolerance that is substantially less than 5 $\mu$m, i.e. the maximum axial throw at any point of the surface is less than 5 $\mu$m.

According to the invention, the wheel hub and the wheel bearing are not finish-machined as individual or separate parts but rather, the surface grinding of the connecting flange for the brake disk only takes place after the wheel bearing has been mounted on the wheel hub and on the assembly formed by the wheel hub and the wheel bearing.

Any contribution to the axial throw, wobble or rotation angle-dependent axial offset of the surface contributed by either or both of the rotating wheel hub on the one hand and the wheel bearing on the other, can be ground down to acceptable tolerances and any wobble or axial throw altogether eliminated. This can be achieved by providing the mounting surface of the outer bearing race and the ground flange surface so that they are exactly parallel to one another. With the invention, plane parallelity is ensured between the mounting surface and the flange surface by premounting the wheel bearing on the wheel hub and then clamping that mounting surface on the workpiece carrier and grinding the flange surface by rotating the grinding wheel and the flange surface by rotation of the wheel hub. The grinding wheel, of course, should have its working surface parallel to the workpiece carrier.

According to a feature of the invention, the ground flange surface is provided with a sensor which detects the angle-dependent offset or throw in the axial direction during the grinding operation and as soon as the measured value falls within this permissible tolerance range, the mounting operation can be halted. In this manner I can ensure that the rotation angle-dependent offset or throw in the axial direction following the machining can be always smaller than, for example, 5 $\mu$m.

The wheel hub can be driven by the spindle of a machine tool drive, e.g. a motor, which is surrounded by the workpiece carrier and the latter can be annular for that purpose. Preferably that spindle is flexibly coupled to the wheel hub by an adapter. The flexible adapter element can compensate for any slight eccentricity between the assembly clamped to the workpiece carrier and the rotation axis of the spindle.

The axis of the grinding wheel, which is preferably cup shaped and engages the planar flange surface to be ground with its rim, is preferably parallel to and laterally offset from the rotation axis of the hub.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
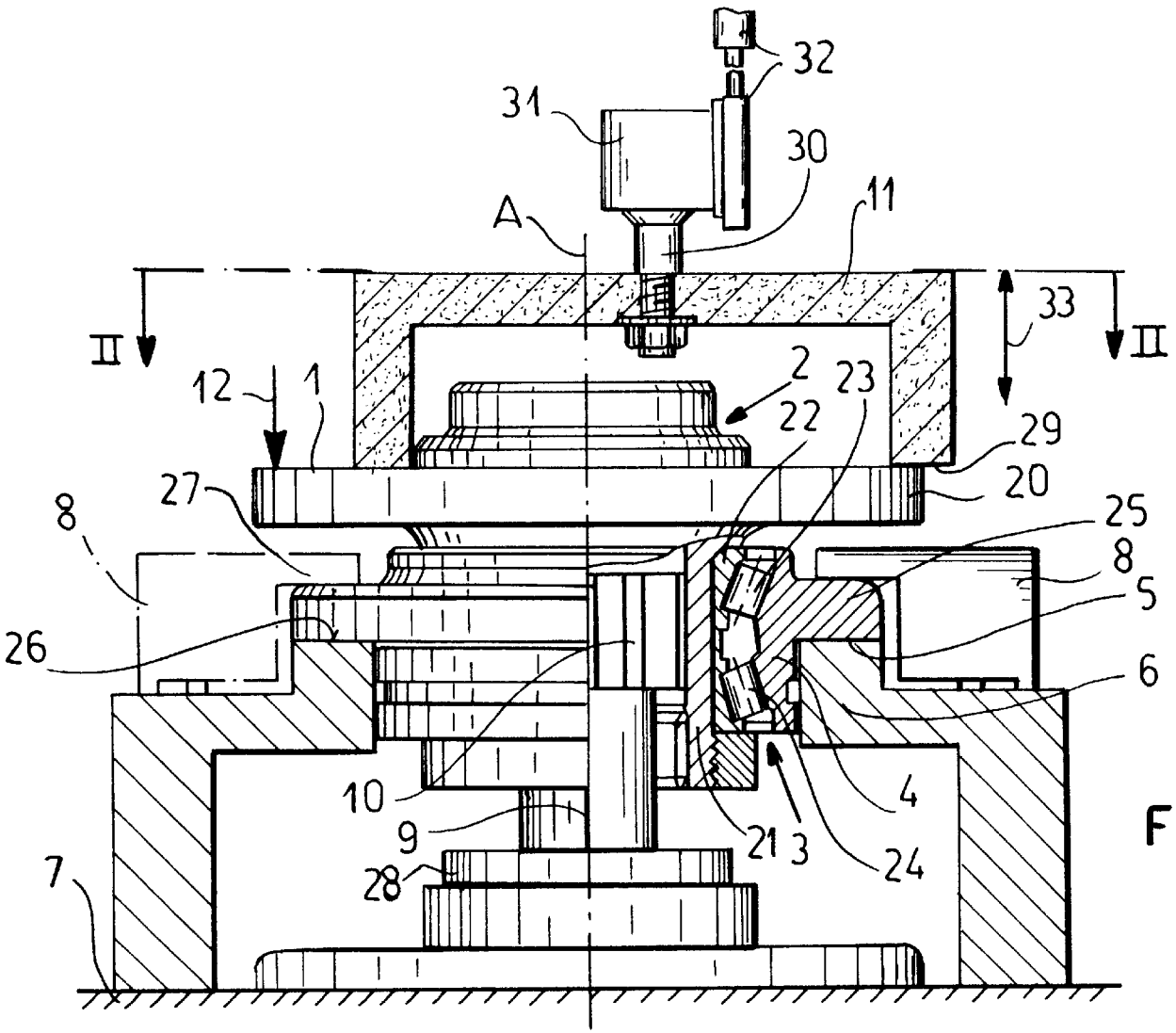
FIG. 1 is an axial cross sectional view, partly broken away diagrammatically illustrating an apparatus for carrying out the method.

In the drawing I show a system for surface grinding a surface 1 of a flange 20 of a wheel hub 2 having a sleeve portion 21 for a motor vehicle. The flange surface 1 is intended to form a mounting surface for a brake disk of a disk brake system for the wheels of the motor vehicle.

Before the surface grinding, the hub 2 is fitted with a wheel bearing 3, the latter comprising, for example, an inner race 22 fitted onto the sleeve portion 21, rollers 23 and 24 and an outer race 4 having a laterally extending flange 25 formed with a mounting surface 5. The latter surface serves for mounting the wheel assembly formed by the bearing 3 and the hub 2 on the motor vehicle.

Figure 2:
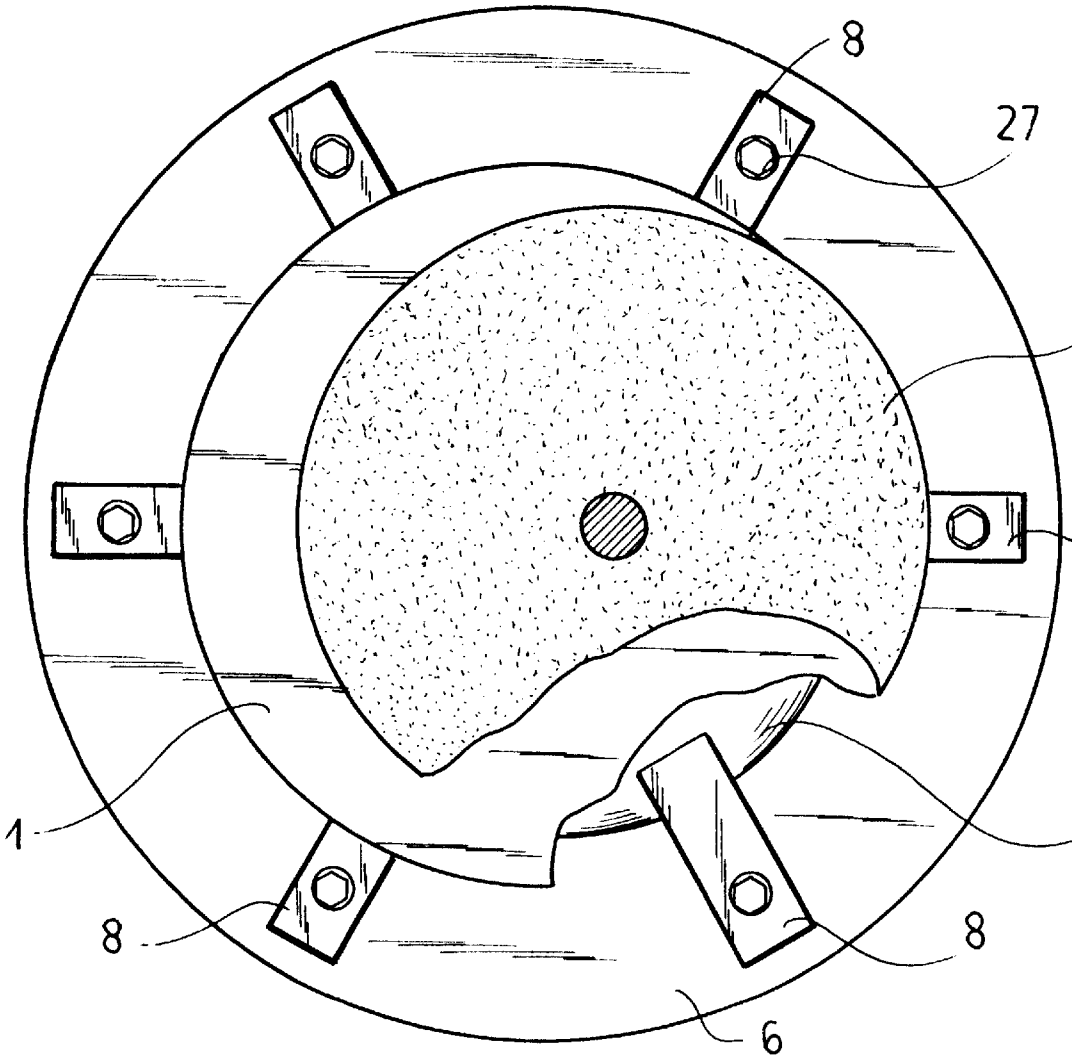
FIG. 2 is a section taken along the line II—II of FIG. 1.

The assembly formed by the wheel hub 2 and the wheel bearing 3 is clamped onto a fixed surface 26 of a workpiece carrier which is nonrotatable and can be mounted, for that purpose, upon a machine bed 7. The clamps, arranged in a star 25 pattern (see FIG. 2), have been shown at 8. Each clamp may comprise a block which is traversed by a respective screw 27 threaded into the workpiece carrier 6. The clamping blocks 8 can have projections 27 overhanging the flange 25 and pressing the mounting surface 5 of the outer bearing race against the surface 26.

The wheel hub 2 is driven by a spindle 9 of the machine tool which can have a drive arrangement represented at 28 and connected by a flexible adapter element 10 to the hub 2.

The grinding tool is a grinding wheel 11 which is cup-shaped and has a rim 29 which can be pressed against the surface 1. The grinding disk 11 can be rotated by the spindle 30 of a motor 31 mounted on a hydraulic or pneumatic piston-and-cylinder arrangement 32 which is capable of lifting the disk 11 away from the hub to allow it to be removed by loosening of the clamp and in addition providing the axial pressure on the disk 11 that may be necessary to press its rim 29 against the surface 1 of the flange 20. The axial displaceability of the grinding disk has been represented by the double-headed arrow 33.

During the grinding process the flange surface 1 of the rotating wheel hub 2 is monitored by a sensor 12 which measures the axial throw of the surface 1 as a function of the angle through which the flange 20 has been rotated. This axial throw represents the planarity of the surface 1 and the grinding is halted when the measured value from the sensor 12 lies within a certain tolerance range. The axial throw upon completion of the grinding operation should be less than 5 $\mu$m and preferably as little as about 2 $\mu$m which can readily be achieved with the instant invention.

I claim:

1. A method of surface grinding a planar flange surface of a flange of a wheel hub, said method comprising the steps of:

(a) fitting a wheel hub having a flange with a surface to be ground and a sleeve portion with a wheel bearing having inner race fitted onto the sleeve portion and an outer bearing race formed with a mounting surface for attachment to a motor vehicle;

(b) clamping said mounting surface of said outer bearing race to an annular stationary workpiece carrier which surrounds a driven spindle of a machine tool by a plurality of clamps, thereby mounting said wheel hub on said workpiece carrier;

(c) flexibly connecting said spindle to said hub; and (d) rotating said wheel hub and said flange about a hub axis with said spindle and contacting said surface of said flange with a rotating grinding disk, thereby surface grinding said flange.

2. The method defined in claim 1, further comprising the step of sensing said surface of said flange and detecting angle-dependent axial displacements representing deviations from planarity of said surface of said flange, and terminating the grinding of said surface of said flange upon measurement of said axial displacements falling within a permissible tolerance range.

3. The method defined in claim 1 wherein said disk is cup shaped and engages said surface of said flange with a rim of said disk, said disk being rotatable about an axis parallel to but laterally offset from the axis of rotation of said hub.

4. The method defined in claim 3, further comprising the step of sensing said surface of said flange and detecting angle-dependent axial displacements representing deviations from planarity of said surface of said flange, and terminating the grinding of said surface of said flange upon measurement of said axial displacements falling within a permissible tolerance range.

* * * * *